US008992055B2

(12) United States Patent
Ng et al.

(10) Patent No.: US 8,992,055 B2
(45) **Date of Patent: *Mar. 31, 2015**

(54) JOINT STRUCTURE, COMPONENTS AND PROCESSES

(75) Inventors: Peter Ng, Hong Kong (CN); Kenneth Ng, Alhambra, CA (US); Edmund Ng, Pasadena, CA (US)

(73) Assignee: Koncept Technologies Inc., Monrovia, CA (US)

( * ) Notice: Subject to any disclaimer, the term of this patent is extended or adjusted under 35 U.S.C. 154(b) by 351 days.

This patent is subject to a terminal disclaimer.

(21) Appl. No.: 13/565,686

(22) Filed: Aug. 2, 2012

(65) Prior Publication Data

US 2013/0301270 A1 Nov. 14, 2013

Related U.S. Application Data

(60) Provisional application No. 61/646,220, filed on May 11, 2012.

(51) Int. Cl.

| | |
|---|---|
| ***F21V 21/14*** | (2006.01) |
| ***H01R 13/46*** | (2006.01) |
| ***F21V 21/26*** | (2006.01) |
| ***H01R 35/04*** | (2006.01) |
| ***F21S 6/00*** | (2006.01) |
| ***F21V 21/30*** | (2006.01) |
| *H01R 103/00* | (2006.01) |
| *H01R 24/58* | (2011.01) |
| *F21Y 101/02* | (2006.01) |

(52) U.S. Cl.

CPC ..... *H01R 13/46* (2013.01); *Y10T 29/49208* (2015.01); *F21V 21/26* (2013.01); *H01R 2103/00* (2013.01); *H01R 24/58* (2013.01); *H01R 35/04* (2013.01); *F21S 6/002* (2013.01); *F21V 21/30* (2013.01); *F21Y 2101/02* (2013.01)

USPC ..... 362/401

(58) Field of Classification Search

CPC ..... F21V 21/14; F21V 21/26; F21V 21/30; F21S 6/002; H01R 13/46; H01R 35/04; H01R 24/58; H01R 2103/00; H01R 41/00; F21Y 2101/02; Y10T 29/49208

USPC ..... 362/285, 287, 418, 419, 410, 411, 413, 362/414, 427, 428

See application file for complete search history.

(56) References Cited

U.S. PATENT DOCUMENTS 5,599,091 A 2/1997 Kira
8,408,761 B2 4/2013 Ng et al.

OTHER PUBLICATIONS

US Notice of Allowance dated Jan. 16, 2014, from related U.S. Appl. No. 13/848,596.
US Office Action dated Sep. 18, 2013, from related U.S. Appl. No. 13/848,596.

*Primary Examiner* — Thomas M Sember
(74) *Attorney, Agent, or Firm* — Foley & Lardner LLP

(57) ABSTRACT

An independent friction joint structure including: at least one plug part having a connection to a device, the device comprising a lamp head; at least one joint part holding the at least one plug part in place, the at least one joint part having at least one holding structure; at least one side part having the ability to generate frictional rotational resistance to keep the at least one plug part in a predetermined position; at least one electrical contact between the at least one side part and the at least one holding structure of the at least one joint part; and at least one screw to fit all the components of the independent friction joint structure together.

20 Claims, 14 Drawing Sheets

JOINT STRUCTURE, COMPONENTS AND PROCESSES

CROSS-REFERENCE TO RELATED PATENT APPLICATIONS

This application claims priority to U.S. Provisional Application No. 61/646,220, filed May 11, 2012, incorporated herein by reference in its entirety.

BACKGROUND

The present invention relates to joint structures for connecting two members for pivotal motion relative to each other and, in particular embodiments, to such joint structures that also provide one or more electrical connections between electrical conductors held by the two members and, in further particular embodiments, to such joint structures that also have a preset frictional resistance to pivotal motion. Further embodiments are directed to components of such joint structures and methods of making and using such joint structures.

SUMMARY OF THE DISCLOSURE

A joint structure according to particular embodiments of the present invention connects a first member and a second member, and allows pivotal motion of one or both members about a pivot axis. The first and second members may be, for example, an arm member and a leg member, respectively, where the arm member is coupled, by the joint device, to the leg member for pivotal motion. However, a joint structure according to other embodiments may be arranged to connect other members together, for pivotal motion.

A joint structure according to an example embodiment of the present invention is employed in a lamp, to allow easy and convenient manual adjustment of the pivot angle of an arm, lamp head or other component of the lamp. In particular embodiments, the joint structure includes one or more electrical connections that connect electrical wires or other conductors in the arm, lamp head or other component. Also in particular embodiments, the joint structure has a preset frictional resistance to pivotal motion that is set to a magnitude sufficient to maintain the pivotal position of the arm, lamp head or other component, once that member is manually moved to a selected pivot position. Also in particular embodiments, the joint structure is configured so as to allow the arm, lamp head or other component to rotate or turn 360 degrees about a rotational axis that is perpendicular to the pivot axis of the joint structure.

According to an aspect of the present disclosure, provided is an independent friction joint structure including: at least one plug part having a connection to a device, the device comprising a lamp head; at least one joint part holding the at least one plug part in place, the at least one joint part having at least one holding structure; at least one side part having the ability to generate frictional rotational resistance to keep the at least one plug part in a predetermined position; at least one electrical contact between the at least one side part and the at least one holding structure of the at least one joint part; and at least one screw to fit all the components of the independent friction joint structure together.

According to an aspect of the present disclosure, provided is a lamp structure including: a lamp head; a lateral body; an independent friction joint structure connecting the lamp head and the lateral body; a counter weight attached to the other end of the lateral body; a stand supporting the lateral body; a balance bar running parallel to the lateral body and connected to the independent friction joint structure and a connection portion located on the stand; and a base supporting the stand.

DETAILED DESCRIPTION OF THE EMBODIMENTS

In the following description of preferred embodiments, reference is made to the accompanying drawings which form a part hereof and in which are shown by way of illustration specific embodiments in which the invention may be practiced. It is to be understood that other embodiments may be utilized and structural changes may be made without departing from the scope of the preferred embodiments of the present disclosure.

Embodiments of the present invention relates to a joint structure for connecting two members and for allowing one or both of the members to pivot relative to the other member, about a pivot axis. Further embodiments of the present invention relate to components of such joint structures and devices and systems that include one or more of such joint structures. Yet further embodiments of the present invention relate to methods of making and using such joint structures, components, devices and systems.

A joint structure according to an example embodiment of the present invention includes one or more electrical connections that connect electrical wires or other conductors in the two members. Also in particular embodiments, the joint structure has a preset frictional resistance to pivotal motion that is set to a magnitude sufficient to maintain the pivotal position of the two members, once one or both member is manually moved to a selected pivot position. Also in particular embodiments, the joint structure is configured so as to allow one or both members to rotate or turn 360 degrees about a rotational axis that is perpendicular to the pivotal axis of the joint structure.

A joint structure according to embodiments of the present invention may be employed in a variety of useful applications, devices and systems, where two members are coupled together for pivotal motion. As a representative example, a joint structure 100 according to an embodiment of the present invention is shown in each of FIGS. 8-12, as connecting arm and leg members of an electrical lamp 110. However, in other embodiments, the joint structure 100 may be configured for connecting other members in other devices or systems, such as, but not limited to connecting one or more tools, weapons, or other implement to an arm or other member, or connecting two arm sections of a complete arm or two leg sections of a complete leg.

Figure 1:
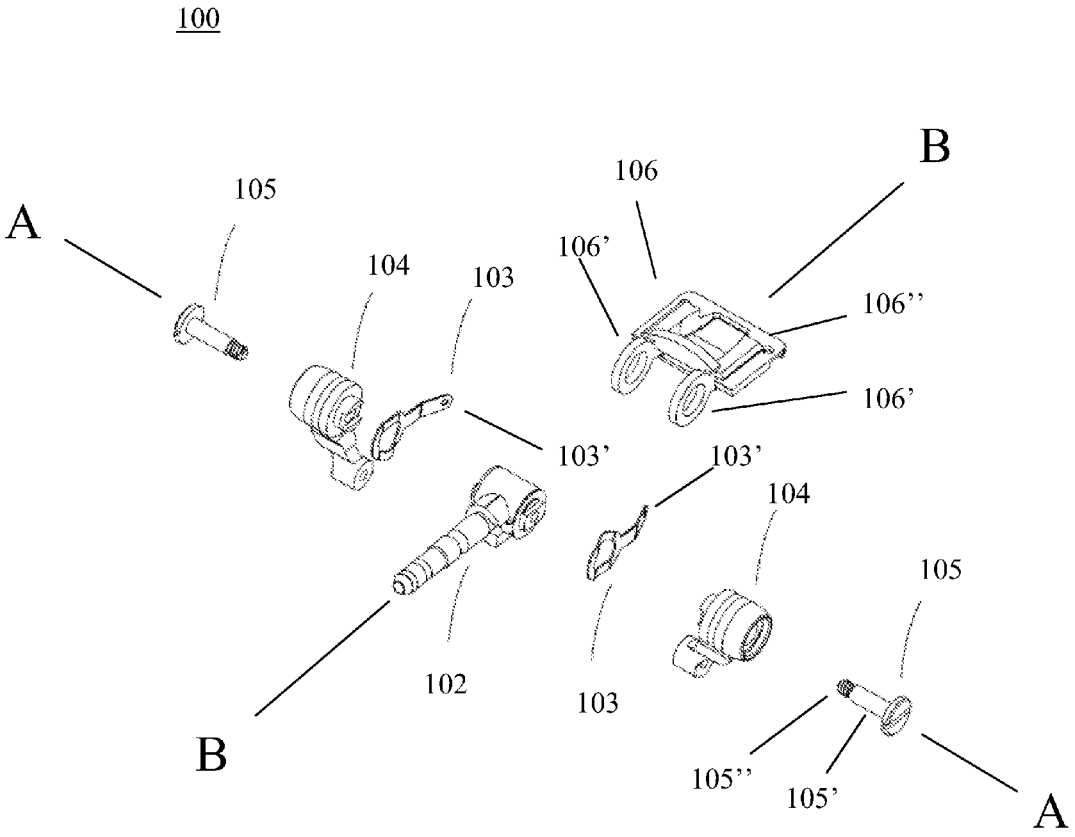
FIG. 1 is a perspective exploded view of components of a joint structure, according to an embodiment of the present disclosure.
Figure 2:
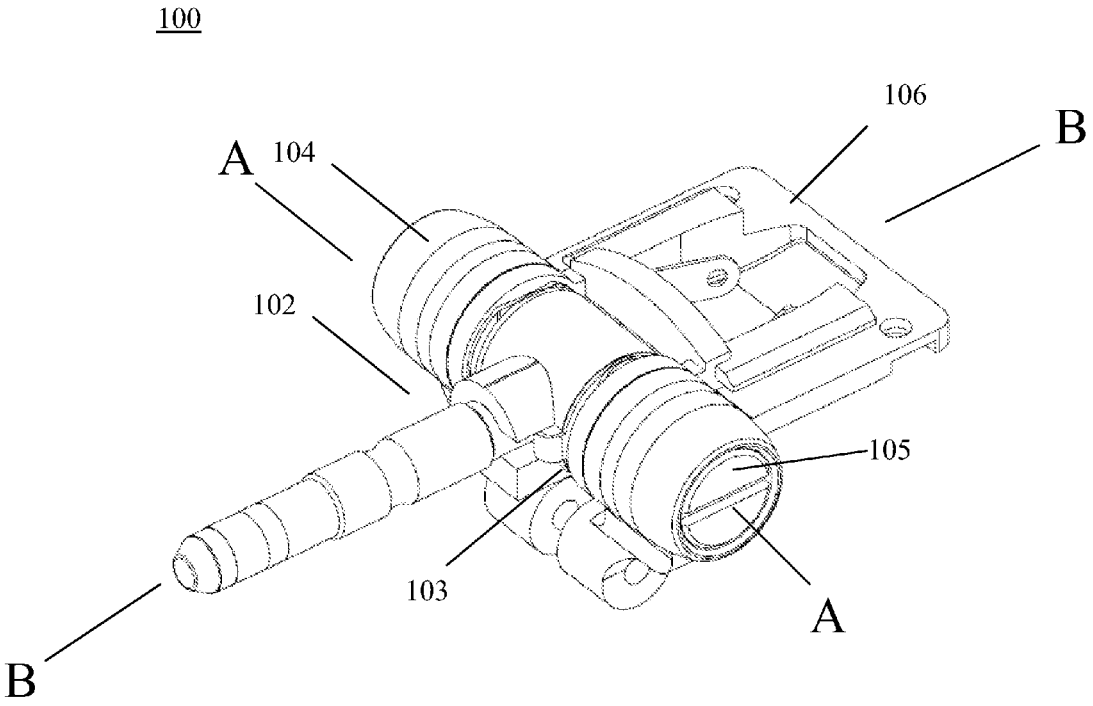
FIG. 2 is a perspective view of the assembled joint structure of FIG. 1, according to an embodiment of the present disclosure.

FIG. 1 is a perspective exploded view of components of a joint structure 100, according to an embodiment of the present disclosure. FIG. 2 is a perspective view of the joint structure 100, in an assembled form. Joint structure 100 includes plug part 102, a pair of electrical contacts 103, a pair of friction-setting parts 104, a pair of screws 105 and bracket 106. Plug part 102 connects to, for example, lamp head 114*a* (shown in FIGS. 8-12) and provides electrical connections to connect electrical power to the electrical contacts 103. While the plug part 102 in the embodiments of FIGS. 8-12 connects electrical power to a lamp head 114*a*, in other embodiments, the plug part 102 may be connected to another device or structure that uses electricity or that requires electric power.

Electrical contacts 103 are made of a suitable electrically conductive metal or other electrically conductive material, to conduct electrical current to or from electrical wires or other conductors (not shown) that are connected to a connection end 103' of the electrical contacts 103. For example, in the lamp embodiments of FIGS. 8-12, the connection ends 103' of the pair of electrical contacts 103 may be connected to a corresponding pair of electrical wires that extend through hollow, interior channels of the lamp arm 112 and lamp leg 116, and to a power source (such as, but not limited to, an electrical plug in a wall socket).

Figure 7A:
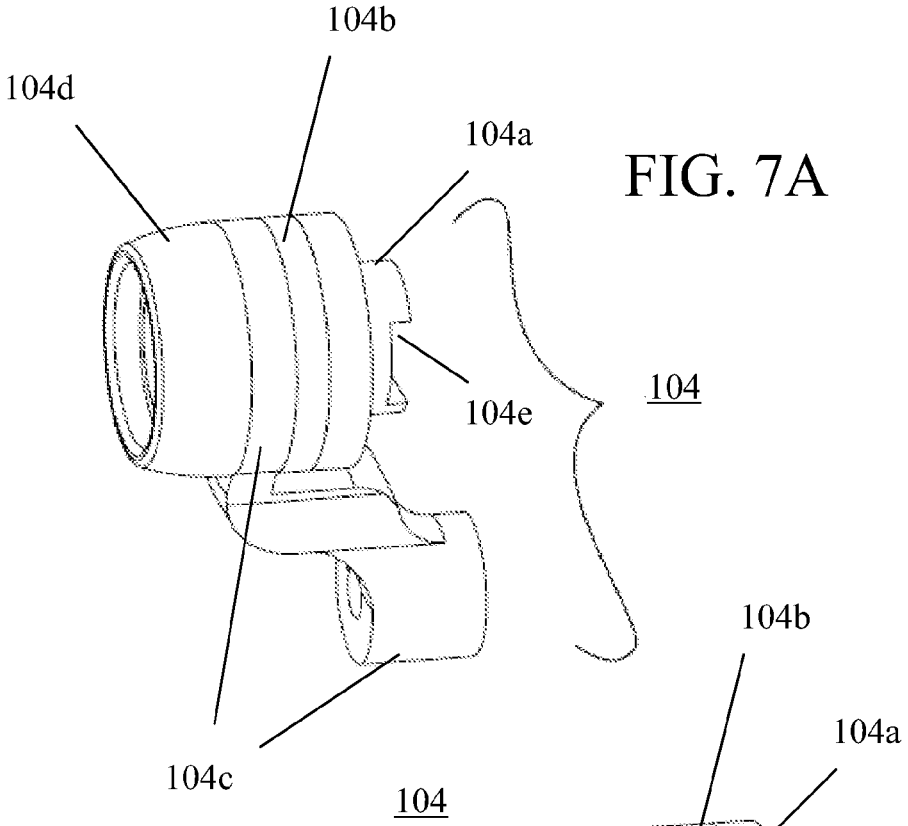
FIG. 7*a* is a perspective view and FIG. 7*b* is a cutaway view of the assembled friction-setting part of FIG. 6, according to an embodiment of the present disclosure.
Figure 7B:
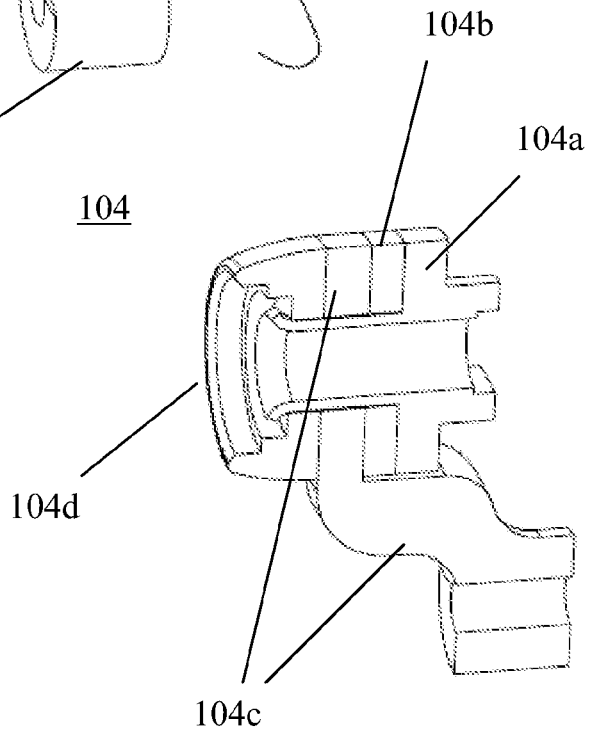
Figure 8:
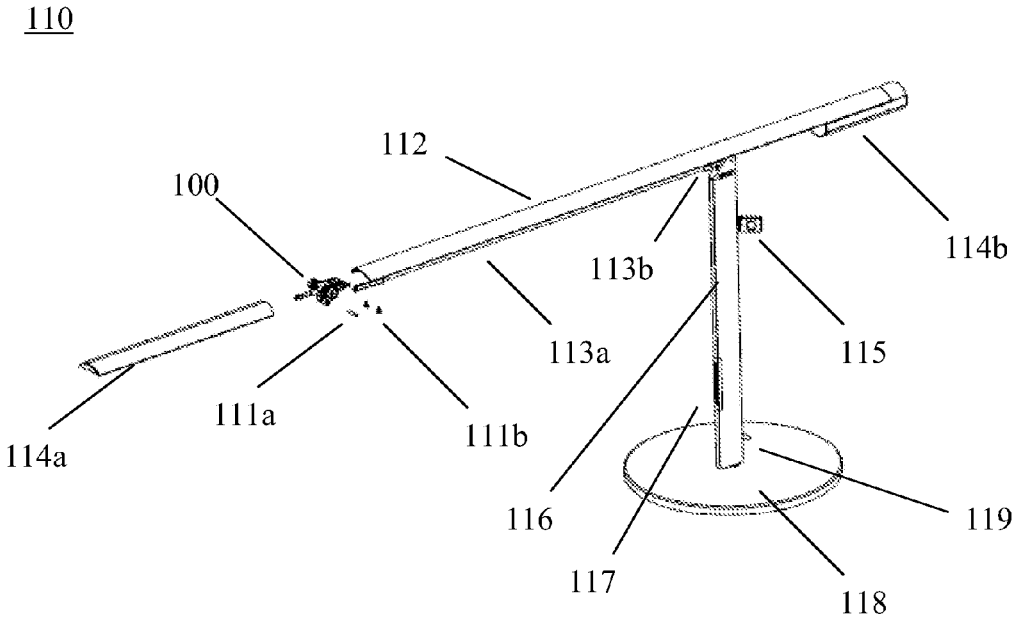
FIG. 8 is a partially-exploded perspective view of a lamp that includes the assembled joint structure of FIG. 2, according to an embodiment of the present disclosure.

Friction-setting parts 104 provide a preset friction force against rotational motion about a pivot axis A of the joint structure, where the preset friction is sufficient to hold and maintain the position of the lamp head 114*a* (or other device) connected to the plug part 102 at any pivot angle within a range of pivotal motion. As described in more detail, below, with respect to FIGS. 6 and 7, each friction-setting part 104 is configured with a preset frictional resistance against rotation, which is set by the force by which components (components 104*a-d* of FIG. 6) of the friction-setting parts are forced (squeezed) together during manufacture of the friction-setting parts 104. Bracket part 106 is configured to hold and connect the joint structure 100 to a member, such as, but not limited to an arm member 112 of a lamp as shown in FIG. 8. Bracket part 106 may be configured in a manner to minimize or avoid contributing to frictional forces against rotation about the pivot axis A. Bracket part 106 includes a pair of ring-shaped extension portions 106' and a frame portion 106". When assembled (as shown in FIG. 2), a portion of a friction-setting part 104 extends through an opening in each respective ring-shaped extension portion 106'. In particular, each ring-shaped extension portion 106' has a circular opening that is sufficiently large so as to minimize frictional interaction with rotating components of the friction-setting parts 104 or the plug part 102. More specifically, the diameter of the opening in each ring-shaped extension portion 106' is selected to be larger than components of the friction-setting parts 104 that extend through those openings, when the joint structure is assembled, to allow free rotation of those components of the friction-setting parts 104 with minimal or no interference from the extension portions 106' of bracket part 106. Bracket part 106 may be made of any suitably rigid material including, but not limited to plastic, metal, wood, ceramic or composite materials.

Screws 105 are used to fix and secure components of the joint structure 100 together, with minimal or no contribution to the frictional resistance about the pivot axis A provided by the friction-setting parts 104. In one embodiment, each of the screws 105 has a shaft that includes a length portion 105' with no threads and an end length portion 105" with threads. The diameter of the length portion 105' may be slightly larger than the diameter of the threaded end portion 105", such that a small shoulder is provided at the interface of the length portions 105' and 105". The shaft of each screw 105 is configured to extend through a central opening in a respective friction-setting part 104, through a central opening in a respective electrical contact 103, through a central opening in the extension portions 106' of bracket part 106, and partially into a threaded opening (108' in FIGS. 3 and 4) of the plug part 102. The threaded portion 105' of each screw 105 is configured to thread into and connect with a respective threaded opening (108' in FIGS. 3 and 4) in the plug part 102, to secure a friction-setting part 104, electrical contact 103 and extension portion 106' of bracket part 106 with one side of the plug part 102. The threaded portion 105' of each screw 105 may be threaded into one of the threaded opening (108' in FIGS. 3 and 4) of the plug part 102, until the shoulder (at the interface of the threaded portion 105' and the non-threaded portion 105" of screw 105) abuts a surface of the plug part 102. In this manner, each screw 105 may be sufficiently tightened to secure components of the joint structure together, yet also be prevented from further rotation once the shoulder of the screw 105 comes into contact with the plug part 102, to minimize or prevent each screw 105 from contributing to frictional resistance against rotary motion about the pivot axis A of the joint structure.

Figure 3:
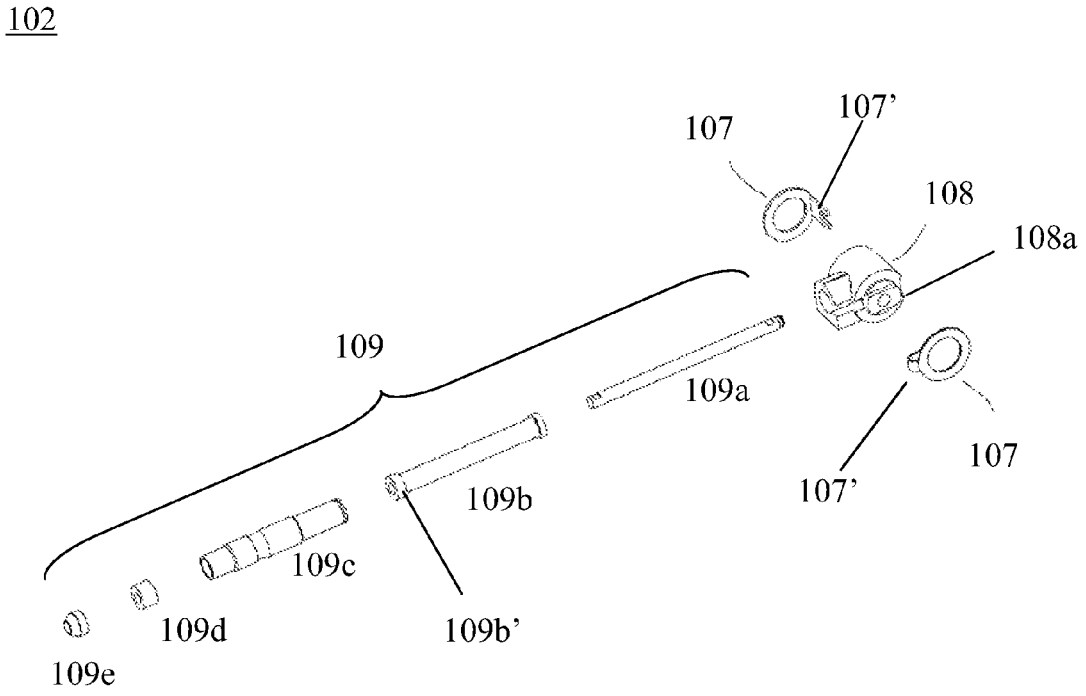
FIG. 3 is a perspective exploded view of components of a plug part of the friction joint structure of FIG. 1, according to an embodiment of the present disclosure.
Figure 4:
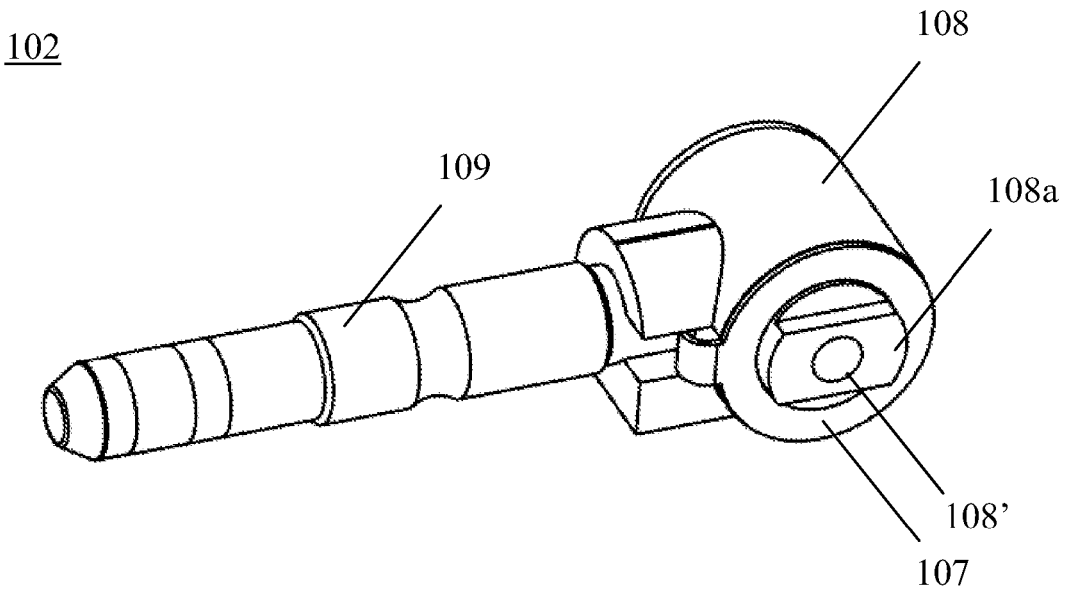
FIG. 4 is a perspective view of the assembled plug part of FIG. 3, according to an embodiment of the present disclosure.
Figure 5:
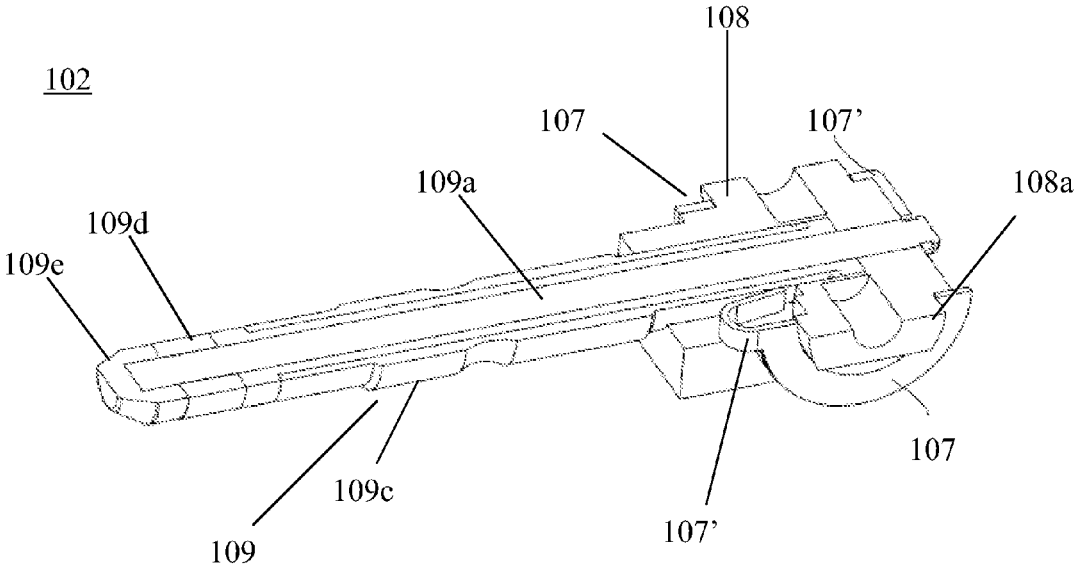
FIG. 5 is a cutaway view of the plug part of FIG. 4, according to an embodiment of the present disclosure.

FIG. 3 is a perspective, exploded view of the plug part 102 of the joint structure 100, according to an embodiment of the present disclosure. FIG. 4 is a perspective view of the plug part 102, in an assembled form. FIG. 5 is a partial cutaway view of the assembled plug part 102 of FIG. 4. In particular embodiments, the plug part 102 is configured to allow selective connection and disconnection (mechanical and electrical) of the lamp head 114*a* to the joint structure 100. In addition, the plug part 102 allows the lamp head 114*a* to rotate about an axis B perpendicular to the pivot axis A of the joint structure, when the lamp head 114*a* is connected to the joint structure 100.

Plug part 102 includes plug part base 108 having a fitting part 108*a* on each side (one side shown in the orientation in FIG. 3), a pair of contact plates 107, and coaxial connector rod 109. The coaxial connector rod 109 has an inner conductor 109*a*, insulator 109*b*, outer conductor 109*c*, conducting head part 109*d* and an insulating end cap part 109*e*. The inner conductor 109*a* is a shaft having a longitudinal dimension.

One end of the inner conductor 109*a* extends through an inner channel in the base 108 (as shown in FIG. 5) and extends a short distance out of one side of the base 108 (the right side in FIG. 5). In that manner, the inner conductor 109*a* is connected to and supported by the base 108 of the plug part 102. The other end (free end) of the inner conductor 109*a* extends out from the other side (the left side in FIG. 5) of the base 108.

The insulator 109*b* is a tube-shaped member that has a longitudinal dimension and a hollow inner channel, through which the inner conductor 109*a* extends, when the plug part 102 is assembled. The insulator 109*a* and the insulator end cap part 109*e*, each may be made of any suitable electrical insulating material, including, but not limited to plastic. The outer conductor 109*c* is a tube-shaped member having a longitudinal dimension and a hollow inner channel, through which the insulator 109*a* extends, when the plug part 102 is assembled. Each of the inner conductor 109*a*, the outer conductor 109*c* and the conductive head part 109*d* is formed of or layered with an electrically conductive material, such as, but not limited to, one or more suitably conductive metals.

When assembled, the inner conductor 109*a* extends through the insulator 109*b*, and the insulator 109*b* extends through the outer conductor 109*c*, such that the free end of the inner conductor 109*a* extends out from an end of the insulator 109*b*. In addition, that end 109*b*' of the insulator 109*b* extends out from an end of the outer conductor 109*c*, to provide an insulating separation between the conductive head part 109*d* and the outer conductor 109*c*. The conductive head part 109*d* is provided over and in electrical contact with the extended free end of the inner conductor 109*a*, and is separated from the outer conductor 109*c* by the end 109*b*' of the insulator 109*b*. The insulating end cap part 109*e* is connected to the extended free end of the inner conductor 109*a*. Accordingly, when assembled, as shown in FIG. 4, the coaxial connector rod 109 includes the conductive head part 109*d* and outer conductor 109*c*, each arranged in an exposed position, to come into electrical contact with a suitable conductor in a socket formed in the lamp head 114*a* (or other suitable device), when the lamp head 114*a* (or other suitable device) is mechanically connected to the connector rod 109. In the illustrated embodiment the connector rod 109 is coaxial, in that it includes two conductors (the inner conductor 109*a* and the outer conductor 109*c*) arranged in a coaxial configuration. In other embodiments, more than two conductors may be employed in a coaxial arrangement. In yet further embodiments, the connector rod 109 may include one or more conductors arranged in linear or other non-coaxial arrangements.

Each fitting part 108*a* of the plug part base 108 is configured to engage with a correspondingly portion of the friction-setting part 104. In particular embodiments, each fitting part 108*a* is configured with a particular shaped extension (generally rectangular shaped extension in FIG. 3) that mates with a correspondingly shaped recess (104*e* in FIG. 7*a*) in a portion of a friction-setting part 104, to inhibit relative rotation between the plug part 102 and the friction-setting parts 104 (i.e., to lock those parts to rotate together), when the fitting parts 108*a* are mated with the friction-setting parts 104, as shown in the assembled structure of FIG. 4. In the illustrated embodiment, the fitting part 108*a* has a rectangular-shaped extension that mates with a rectangular-shaped groove or recess in the friction-setting part 104. However, in other embodiments, other suitable shaped extensions and grooves or recesses that inhibit relative rotation may be employed, instead of or in addition to the rectangular shapes shown in the drawings. Also, in other embodiments, the groove or recess may be provided on the fitting parts 108*a*, while the mating extension may be provided on each of the friction-setting parts 104.

Contact plates 107 serve to conduct electricity or electrical current to or from the coaxial connector rod 109. Each of the contact plates 107 includes an extension portion 107' that extends to a position in contact with a respective one of the inner and outer conductors 109*a* and 109*c*. The extension portion 107' on one of the contact plates 107 may have a different shape than the extension portion 107' on the other contact plate 107. The extension portion 107' on one of the contact plates 107 extends into a channel formed in the base 108 to make electrical contact with the inner conductor 109*a*). The extension portion 107' on the other contact plate 107 extends around one side of the base 108 (the right side in FIG. 5) to make electrical contact with the exposed end of the outer conductor 109*c* (the end on the right side of FIG. 5). In this manner, electrical connections can be made through contact plates 107 to the coaxial connector rod 109 and, in turn, to the lamp head 114*a* (or other device). When the joint structure 100 is assembled, the contact plates 107 are arranged in electrical contact with the contacts 103, which are electrically connected to wires or other conductors (not shown), as discussed above.

The coaxial connector rod 109 is configured as a plug-like structure to plug into a correspondingly shaped socket in, for example, a lamp head 114*a* (or other device) that requires electric power. In other embodiments, the other device may include, for example, but not limited to, an audio device, speaker, solar panel, mobile charging device, electronic tool, electronic display or other communication device, or the like. Each fitting part 108*a* includes a threaded opening 108' configured to receive the threaded end of a screw 105, as described above. As can be seen in FIG. 5, two-pole electrical connections are made (via contact plates 107) to the inner and outer conductors 109*a* and 109*c* of the coaxial connector rod 109.

Figure 6:
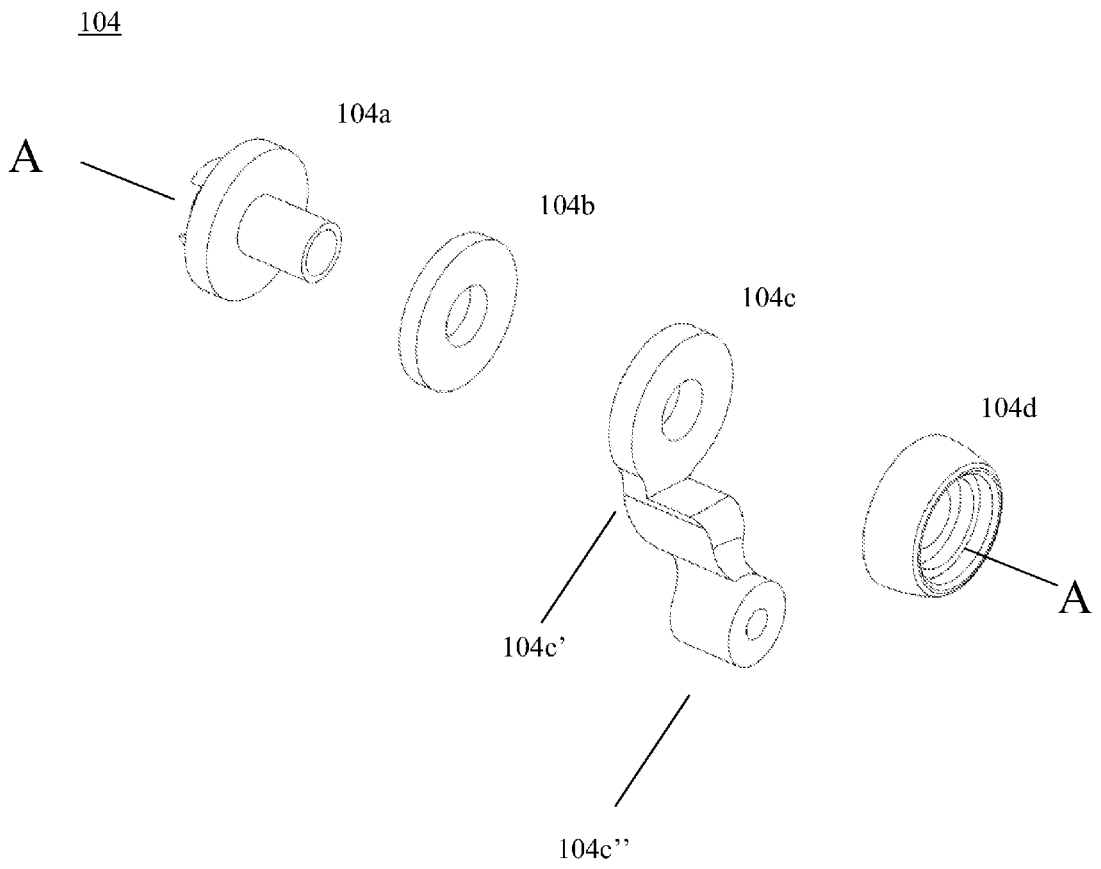
FIG. 6 is a perspective exploded view of components of a friction-setting part of the joint structure of FIG. 1, according to an embodiment of the present disclosure.

FIG. 6 is a perspective exploded view of a friction-setting part 104 of the joint structure 100, according to an embodiment of the present disclosure. FIG. 7*a* is a perspective view of the friction-setting part 104, in an assembled form. FIG. 7*b* is a partial cutaway view of the friction-setting part 104 of FIG. 7*a*. Each friction-setting part 104 includes shaped part 104*a*, friction inducing ring 104*b*, linkage structure 104*c* and lathed part 104*d*. Shaped part 104*a* has one end (leftwards facing in FIG. 6) that has a groove or recess shaped to fittingly engage with the fitting part 108*a* of the plug part base 108 as described above. The other end of shaped part 104*a* (rightwards facing in FIG. 6) has a tube like extension structure which extends through holes in inducing ring 104*b*, linkage structure 104*c*, and lathed part 104*d*. The end of the tube structure on the rightwards-facing side of shaped part 104*a* may be flared out like a rivet to be secured with the lathed part 104*d*, and to secure the components 104*a-d* of friction-setting part 104 together.

The friction inducing ring 104*b* translates rotational friction energy from the shaped part 104*a* to the linkage structure 104*c*, and vice versa. This may be done by pressing the linkage structure 104*c* together with the friction inducing ring 104*b* (e.g., by flaring the end of the tube-like structure of the shaped part 104*a* enough to press the parts 104*b* and 104*c* together with enough pressure to allow those parts to rotate relative to each other, but also to impart a desired magnitude of frictional force against such relative rotation). In this manner, the frictional force against relative rotation of the parts 104*b* and 104*c* can be selected and set, for example, at the factory at the time of manufacturing the friction-setting part 104. The magnitude of frictional force is selected, based on the weight of the member to be held by the joint structure (for example, the weight of the lamp head 114*a* in FIG. 8).

Figure 11:
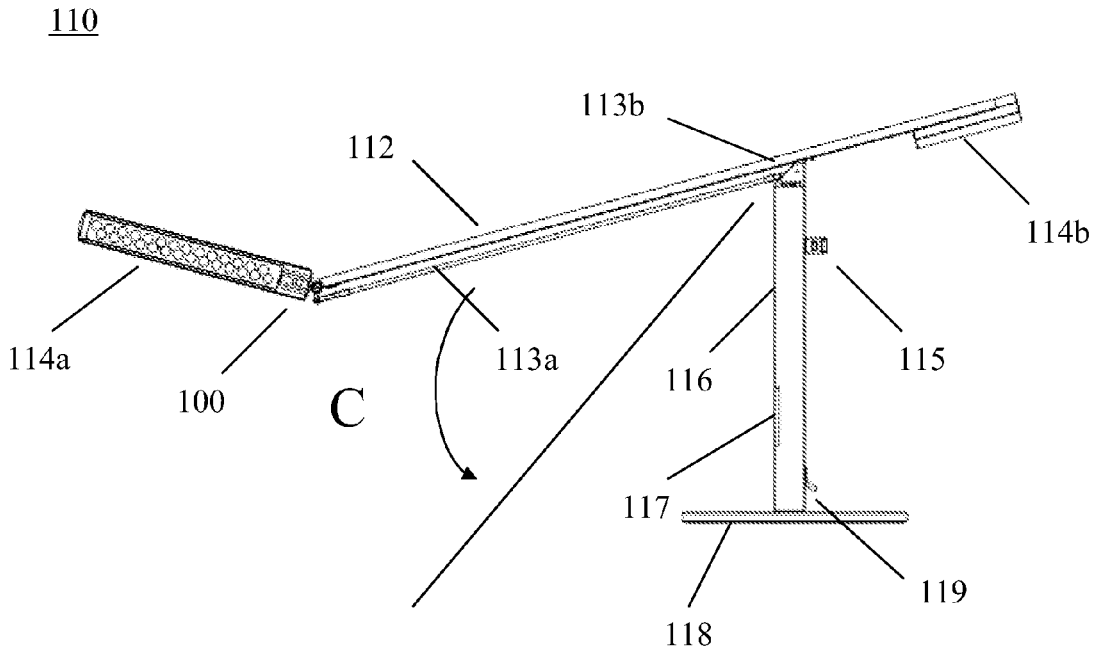
FIG. 11 is yet another side view of the assembled lamp of FIG. 8, showing an example of a rotational position and pivot position of the lamp head, according to an embodiment of the present disclosure.
Figure 12:
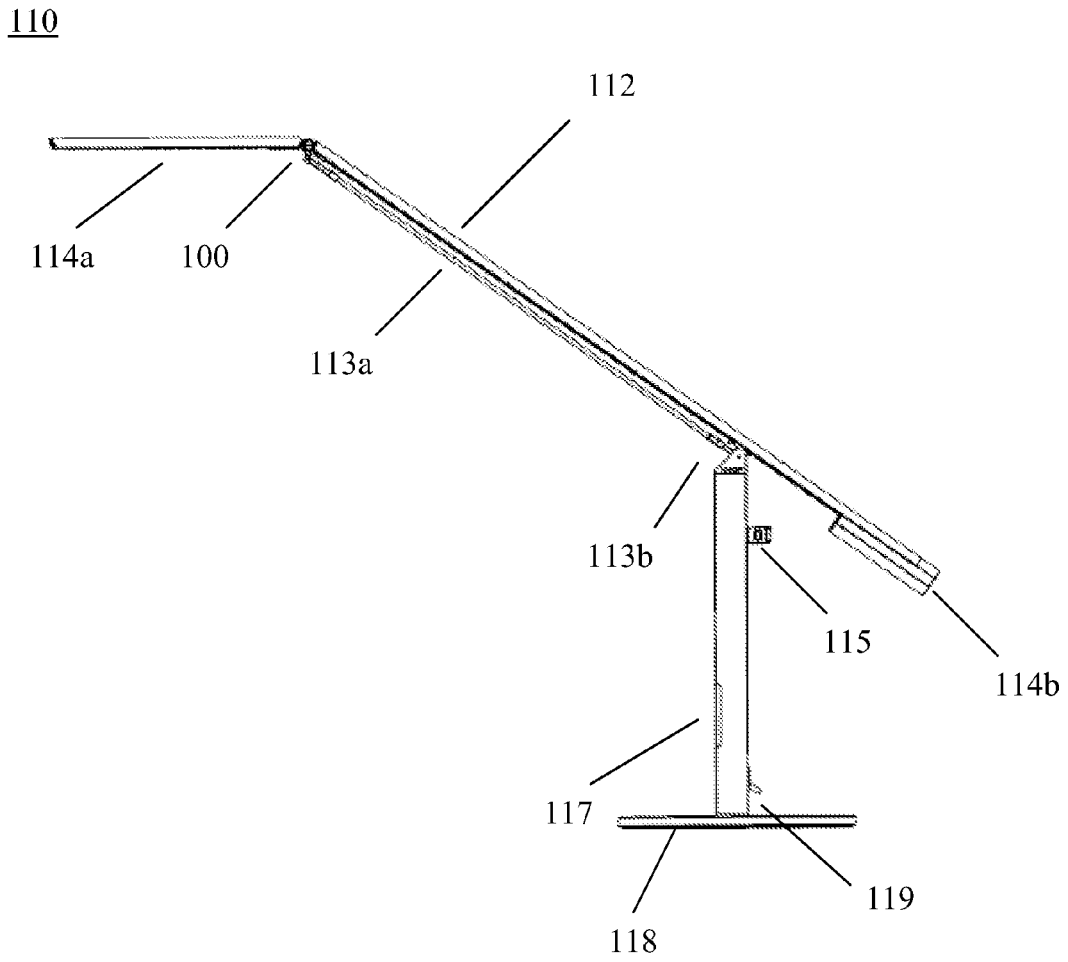
FIG. 12 is yet another side view of the assembled lamp structure of FIG. 8, showing an example of a pivot position of the arm of the lamp and a corresponding pivot position of the lamp head, according to an embodiment of the present disclosure.

The linkage structure 104*c* has a body portion 104*c*' provided with a hole through which the tube-shaped portion of shaped part 104*a* extends. The linkage structure 104*c* also includes an extension portion 104*c*" that includes a hole for connection to, for example, a balance rod 113*a* (FIGS. 8-12), or any similar structure. When connected with the balance rod 113*a*, the linkage structure 104*c* is held from rotating about axis A, at any given angular position of the arm 112 along a range of angular motion C shown in FIG. 12. As the angle C changes, the balance rod 113*a* rotates the linkage structure 104*c* by a corresponding amount, to maintain the orientation of the lamp head 114*a* in a manually set position (for example, a horizontal position, as shown in FIG. 12). Accordingly, the lamp head 114*a* may remain in a preset orientation (e.g., horizontal orientation) while the arm 112 of the lamp is moved to change the angle C.

With the linkage structure 104*c* held from rotation (about axis A) by the balance rod 113*a*, the shaped part 104*a* may be rotated relative to the linkage structure 104*c*, against frictional force imparted by the friction inducing ring 104*b*. The force by which the parts 104*a-d* are pressed together (and against the friction inducing ring 104*b*) by flaring the end of the tube-shaped portion of the shaped member 104*a*, determines the amount of frictional force imparted against rotation of the shaped part 104*a* relative to the linkage structure 104*c*. Accordingly, this force may be set at the factory, when the friction-setting part 104 is assembled.

The lathed part 104*d* functions with the tube-shaped portion of the shaped part 104*a* to secure all the components of the friction-setting part 104 together—namely, once the tube portion of shaped part 104*a* extends through the holes of the friction inducing ring 104*b*, the hole of linkage joint structure 104*c*, and through the hole of lathed part 104*d*, the tube portion is then flared out to act as a rivet to secure all the components 104*a*, 104*b*, 104*c* and 104*d* together. In one embodiment, after all components 104*a-d* are assembled in this manner, the narrower, tube-shaped end of shaped part 104*a* will be stamped or pressed, as shown in FIG. 7*b*, in order to flare out and act as a rivet to securely fasten all the components 104*a-d* to one another to form side part 104. The friction-setting part 104, therefore, is configured to provide a consistent friction force that is introduced between shaped part 104*a* and linkage joint structure 104*c* by pressing on the friction inducing ring 104*b*, regardless of the strength of any external forces applied on the friction inducing ring 104*b* (such as, for example, from screws).

In one embodiment, the center of the friction-setting part 104 has an open channel along the axis A, to allow a screw to go through, for example. As described above, screws 105 have a shaft portion that is smooth, with no threads. When assembled, that smooth, threadless shaft portion of the screws 105 extends through the open channel in the friction setting part 104, so that the screws do not affect the frictional rotational resistance about axis A.

FIG. 8 is a perspective view of the joint structure 100 being applied to a lamp structure 110, according to an embodiment of the present disclosure. Lamp structure 110 includes joint structure 100, lateral body or arm 112, lamp head 114*a*, horizontal rods or pins 111*a*, vertical screws 111*b*, balance rod 113*a*, balance rod connector portion 113*b*, counter weight 114*b*, sensor switch 115 (such as, but not limited to a motion or proximity sensor switch that switches power off when no motion is sensed within the proximity of the sensor for a defined period of time), leg 116, touch or sliding dimmer switch 117, and base 118. A portion of a power cord (electrical conductor for electrical power) is shown at 119. Joint structure 100 has been described above in FIGS. 1-7. Arm 112 is the lateral body of the lamp structure 110. The combined weight of the lamp head 114*a* and arm 112 is balanced via the counter weight 114*b*. The joint structure 100 is connected to the lamp head 114*a* by horizontal pins 111*a*, and the joint structure 100 is connected to the arm 112 by vertical screws 111*b*.

The balance rod 113*a* is a structure that runs parallel to the arm 112 and that also connects to the joint structure 100, as described above, in order to maintain the positioning of the lamp head 114*a*, so that the lamp head 114*a* stays in a given position once the user has moved it to a given position.

Arm 112 and balance rod connector portion 113*b* are connected to leg 116 by any suitable pivot joint, to allow the arm 112 to pivot along a pivot path C shown in FIG. 12. The leg 116 supports arm 112 and the balance rod connector portion 113*b*. One or more switches 115 may be connected along the electrical conductors (not shown) in the leg 116, to control power to the lamp structure 100. Leg 116 is supported by base 118.

Figure 9:
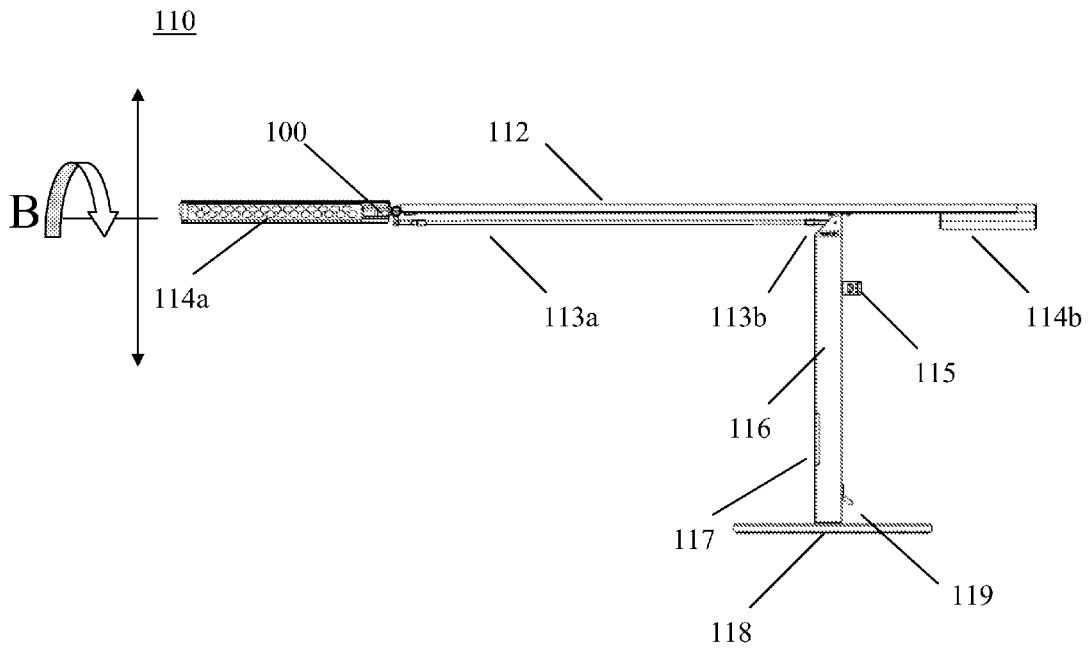
FIG. 9 is a side view of the assembled lamp of FIG. 8, illustrating a range of rotational positions of the lamp head, according to an embodiment of the present disclosure.

FIG. 9 is a side view of the lamp structure having a joint structure 100, according to an embodiment of the present disclosure. In FIG. 9, the bottom surface of lamp head 114*a* can be seen—showing an array of LEDs (light emitting diodes) arranged in a zig-zag pattern. In one embodiment, the LEDs may be arranged in a zig-zag pattern to most efficiently conserve resources. In one embodiment, the LEDs may be arranged in multiple rows or other patterns that may be deemed efficient or power-saving. Also in FIG. 9, it is shown that the lamp head 114*a* can be rotated about the axis B of the connector rod 109. Thus, the joint structure 100 allows the lamp head 114*a* to not only pivot up and down, but also rotate in any angle due to its robust configuration.

Figure 10:
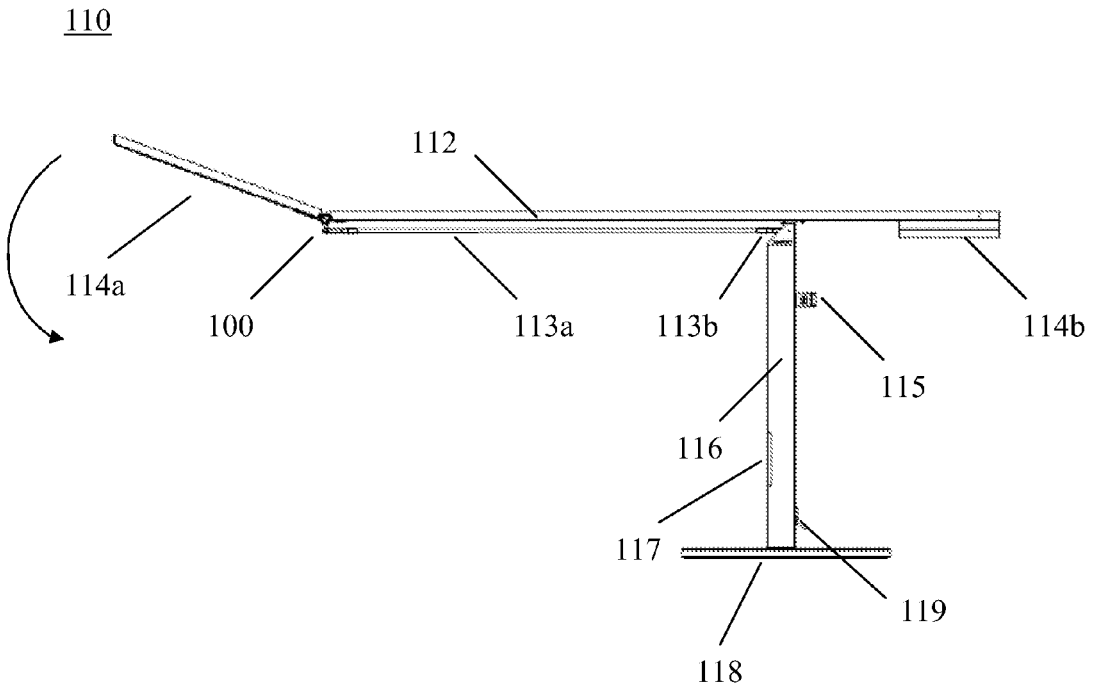
FIG. 10 is another side view of the assembled lamp of FIG. 8, illustrating a range of pivot positions of the lamp head, according to an embodiment of the present disclosure.

FIG. 10 is another side view of the lamp structure 110 using the joint structure 100, according to an embodiment of the present disclosure. In FIG. 10, the lamp head 114*a* is shown as pivoted about the axis A (extending into and out of the page) to be angled upwards relative to the horizontal position of FIG. 9. FIG. 11 is yet another side view of the lamp structure having the joint structure 100, according to an embodiment of the present disclosure. In FIG. 11, the lamp head 114*a* is shown as being positioned slightly upwards at an angle, and rotated 90 degrees so that the bottom surface of the lamp head 114*a* with its LEDs is facing outwards from the page. In FIG. 12, the lamp head 114*a* is shown as being horizontal, but positioned in a relatively high position (with the counter weight 114*b* in a low position). Once the user positions the lamp head 114*a* in such a position, the joint structure 100 maintains the orientation of the lamp head 114*a*, even if the angle C of the arm 112 is changed.

After the lamp head 114*a* is assembled to a lamp structure 110, the lamp head 114*a* can be rotated with two axes, or stay at a desired angle without requiring cumbersome electrical wires to run through the independent friction joint structure 100. The lamp head 114*a* angle is determined by the angle of the plug part 102, which is engaged to the linkage structure 104*c* through the friction-setting parts 104, but can still be rotated against one another when the friction force is overcome.

Figure 13:
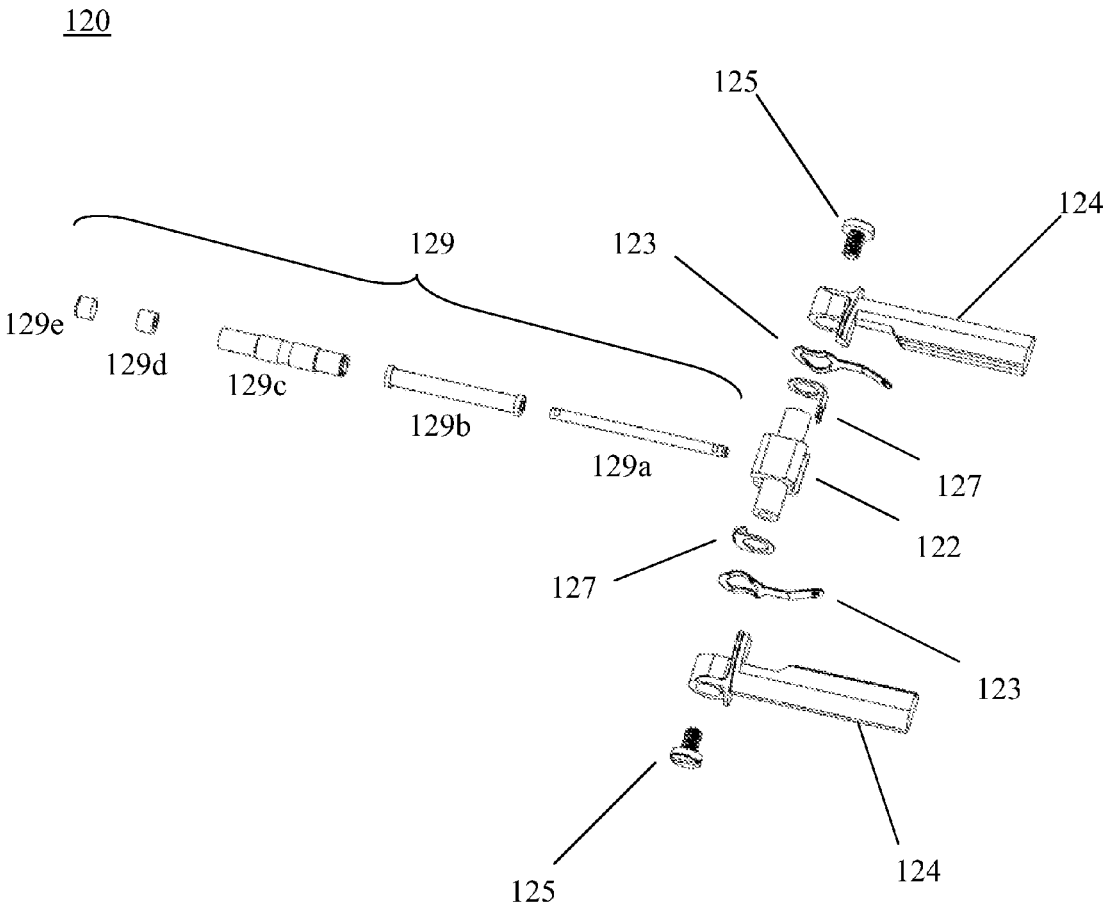
FIG. 13 is a perspective exploded view of a joint structure, according to another embodiment of the present disclosure.
Figure 14:
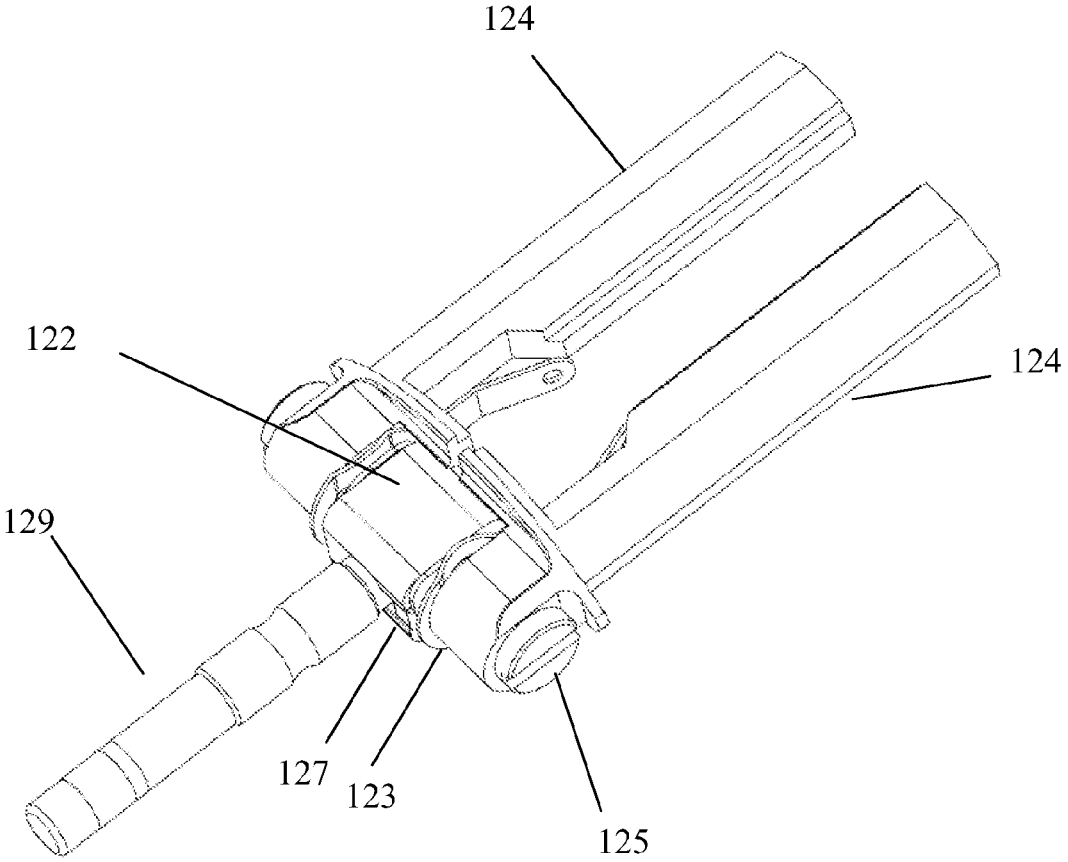
FIG. 14 is a perspective view of the assembled joint structure of FIG. 13.

FIG. 13 is a perspective exploded view of a joint structure 120, according to another embodiment of the present disclosure. FIG. 14 is a perspective view of the joint structure of FIG. 13, in an assembled form. Joint structure 120 includes base portion 122, contact plates 127, electrical contacts 123, side parts 124, screws 125, and coaxial connector rod 129 which in turn includes inner conductor 129*a*, insulator 128*b*, outer conductor 129*c*, second conductive part 129*d* and head 129*e*. Base portion 122 has ends that fit through and engage with contact plates 127 and also electrical contacts 123, which deliver or transfer electricity from elsewhere (an electrical cord, such as cord 119 described above) on the device to the coaxial connector rod 129. Base portion 122 has two rod shaped extensions that fit through openings in the contact plates 127 and electrical contacts 123. The side portions 124 also having openings through which the rod-shaped extensions of the base portion extend. The side portions 124 also can be secured to the rod-shaped extensions of the base portion 122 with screws 125. The contact plates 127 and electrical contacts 123 can be made of any electrically conductive material, such as, but not limited to, for example copper, gold, silver or other suitable conductive material. The side parts 124 allow the frictional rotation to occur by pressure being exerted on its flanges or wing-like structures, which may be connected to a portion of a lamp structure or other fixed part of the structure. Thus, frictional rotational force is generated when base portion 122 and side parts 124 are squeezed or pressed together in order to move the entire friction joint structure 120, and to also position the coaxial connector rod 129 at a specific angular position. The frictional resistance force of the joint structure 120 is provided by the opening on side part 124 being slightly smaller than the rod-shaped part of base portion 122. In another embodiment, the frictional rotational force can be adjusted by tightening or loosening the screws 125. The material of the side parts 124 can be, for example, plastic or any such similar material.

According to one embodiment, the independent friction structure of the present disclosure may be a joint structure used to connect two parts of a lamp to allow both a rotation along the joint axis and a second rotation perpendicular to the joint axis. The joint structure also contains electrical contacts for allowing an electrical connection through the joint structure without the use of an external wire. Two ends along the axis of the joint may be equipped with two independent friction joint structures or side parts, which introduce force to the joint to hold up a second part of the lamp. In one embodiment, an advantage of the independent joint friction structure is that the friction force it generates is independent from how tightly other components in the joint, or how tightened they are by a screw or how hard they are pressed against each other. Furthermore, the electrical contacts, which may be sandwiched in the middle of the joint structure, may not be strongly pressured against each other so as to potentially damage the contacts during movement of the independent friction joint structure. With the independent friction joint structures, the electrical contacts need not be pressured strongly against each other while the joint still maintains the force that it needs to cause frictional rotational force. The present disclosure may become particularly useful in the case of a lamp with a linkage joint design. The angle of the second part of the lamp remains the same when the lamp is moved, but its angle can still be adjusted if desired due to the friction joint structure being independent of the rest of the components. And all the above-described functionalities and more may be achieved in a single compact and lightweight joint structure.

While particular embodiments of the present disclosure have been shown and described, it will be obvious to those skilled in the art that the present disclosure is not limited to the particular embodiments shown and described and that changes and modifications may be made without departing from the spirit and scope of the appended claims.

What is claimed is:

1. A friction joint system comprising:

at least one plug part configured for connection to an electrically powered device;

at least one side part providing a frictional rotational resistance against relative rotational motion of the at least one plug part;

at least one electrical contact between the at least one side part and the at least one plug part; and at least one connector that connects the at least one plug part, the at least one side part and the at least one electrical contact together;

wherein the at least one plug part comprises a connector rod portion configured for connection to the electrically powered device, and the connector rod portion has a longitudinal dimension and is configured to couple to the electrically powered device and allow rotational motion of the electrically powered device about an axis of the longitudinal dimension of the connector rod portion when the connector rod portion is coupled to the electrically powered device.

2. The friction joint system of claim 1, wherein the at least one plug part comprises:

a plug part base having a fitting part; and at least one contact plate configured to fit around the fitting part;

wherein the connection rod portion is affixed to the plug part base.

3. The friction joint system of claim 2, wherein the at least one side part comprises:

a first part having a slot in which the fitting part is received, and an extension structure;

a friction inducing ring having a hole through which the extension structure extends;

a linkage joint structure having a hole through which the extension structure extends, and portion configured to connect to a balance bar; and a second part having a hole through which the extension structure extends, an end portion of the extension structure being flared out to secure all the first part, friction inducing ring, linkage joint structure and second part of the side part together.

4. The friction joint system of claim 1, further comprising a bracket having two rings arranged on opposite respective sides of the plug part.

5. The friction joint system of claim 1, wherein the at least one electrical contact comprises a ring structure made of a copper, aluminum, or another electrically conductive material.

6. The friction joint system of claim 1, wherein the at least one connector comprises a screw having a threaded portion and a non-threaded portion so as to be threaded to, but not beyond a certain depth.

7. The friction joint system of claim 1, further comprising:

a lamp head as the electrically powered device;

a lateral body having a first end portion connected to the lamp head through the at least one plug part;

a counter weight attached to a second end portion of the lateral body;

a stand supporting the lateral body;

a balance bar extending adjacent to the lateral body and connected to the at least one side part and to a connection portion located on the stand; and a base supporting the stand.

8. The friction joint system of claim 7, wherein the lamp head comprises a plurality of light emitting diodes (LEDs) arranged in a pattern comprising a zig-zag pattern, or at least two rows.

9. The friction joint system of claim 7, wherein the counter weight is selected so as to balance the weight of the lamp head on the lateral body.

10. The friction joint system of claim 7, further comprising:

at least one switch; and at least one monitor, the monitor monitoring at least one metric of the lamp structure, the metric comprising at least one of power levels, power consumption, brightness, and remaining power.

11. The friction joint system of claim 1, wherein the connector rod portion has at least one electrically conductive portion that electrically couples the electrically powered device to the at least one electrical contact when the connector rod portion is coupled to the electrically powered device.

12. The friction joint system of claim 1, wherein the connector rod portion has at least one electrically conductive portion that electrically couples the electrically powered device to the at least one electrical contact when the connector rod portion is coupled to the electrically powered device.

13. The friction joint system of claim 1, wherein the connector rod portion has a coaxial structure comprising an inner electrical conductor, an outer electrical conductor and an electrical insulator arranged between the inner and outer electrical conductors.

14. A friction joint system comprising:

a base portion having a first side;

at least one contact plate coupled to the first side of the base portion;

at least one side part coupled to the first side of the base portion and providing a frictional rotational resistance against relative rotational motion of the base portion;

at least one electrical contact coupled to the first side of the base portion between the at least one contact plate and the at least one side part, the at least one electrical contact in electrical communication with the at least one contact plate;

at least one connector connecting the at least one contact plate, the at least one side part and the at least one electrical contact together with the base portion; and a coaxial connector rod coupled to the base portion, wherein the coaxial connector rod comprises an inner conductor, an insulator, an outer conductor, a second conductive part and a head.

15. The friction joint system of claim 14, wherein the first side of the base portion comprises a rod-shaped extension and wherein the at least one contact plate, the at least one side part, and the at least one electrical contact each have an opening through which the rod-shaped extension extends.

16. The friction joint system of claim 14, wherein the rod-shaped extension has an opening for the at least one connector to engage in order to secure the at least one electrical contact, the at least one side part, and the at least one contact plate together with the base portion.

17. The friction joint system of claim 14, wherein the at least one side part has a flange that is moveable in response to an external pressure to adjust the frictional rotation resistance.

18. A friction joint system comprising:

a plug part having a base portion and a connector rod, the connector rod configured to connect to and hold an electrically powered device;

a first side part and a second side part, the first side part arranged on a first side of the base portion of the plug part, the second side part arranged on a second side of the base portion of the plug part, the second side being opposite to the first side, the first and second side parts providing a frictional rotational resistance against rotational motion of the at least one plug part relative to the first and second side parts;

at least one first electrical contact arranged on the first side of the plug part and in electrical communication with the connector rod of the plug part; and at least one connector that connects the at least one plug part, the at least one side part and the at least one electrical contact together;

wherein the connector rod has a longitudinal dimension and is configured to couple to the electrically powered device and allow rotational motion of the electrically powered device about an axis of the longitudinal dimension of the connector rod when the connector rod is coupled to the electrically powered device.

19. The friction joint system of claim 18, wherein the connector rod has an electrically conductive portion that electrically couples the electrically powered device to the at least one first electrical contact when the connector rod is coupled to the electrically powered device.

20. The friction joint system of claim 18, wherein the connector rod has first and second electrically conductive portions, wherein the at least one first electrical contact is in electrical communication with the first electrically conductive portion of the connector rod, and wherein the system further comprises at least one second electrical contact arranged on the second side of the plug part and in electrical communication with the second electrically conductive portion of the connector rod.

* * * * *